US006751889B2

(12) United States Patent
Wells

(10) Patent No.: US 6,751,889 B2
(45) Date of Patent: Jun. 22, 2004

(54) PHOTOGRAPHIC MEDIA DRYER

(75) Inventor: Leslie R. Wells, Bounds Green (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/256,795

(22) Filed: Sep. 27, 2002

(65) Prior Publication Data

US 2003/0061727 A1 Apr. 3, 2003

(30) Foreign Application Priority Data

Sep. 29, 2001 (GB) ..... 0123479

(51) Int. Cl.[7] ..... F26B 11/02

(52) U.S. Cl. ..... 34/639; 34/638; 34/640; 34/643; 34/654

(58) Field of Search ..... 34/639, 643, 638, 34/640, 654, 460, 461, 464, 506, 508

(56) References Cited

U.S. PATENT DOCUMENTS 3,287,821 A * 11/1966 Schregenberger ..... 34/643
4,693,014 A 9/1987 Caflisch et al.
5,022,167 A 6/1991 Nakamura
5,031,339 A 7/1991 Michelson
5,150,955 A * 9/1992 Devaney et al. ..... 396/620
5,181,329 A 1/1993 Devaney, Jr. et al.
5,390,428 A 2/1995 Pummell
5,579,072 A 11/1996 Frank et al.
6,134,811 A * 10/2000 Berger et al. ..... 34/618
6,231,001 B1 * 5/2001 Kramer et al. ..... 242/615.11

FOREIGN PATENT DOCUMENTS

GB 1422848 1/1976

* cited by examiner

*Primary Examiner*—Ira S. Lazarus
*Assistant Examiner*—Kathryn S. O'Malley
(74) *Attorney, Agent, or Firm*—Frank Pincelli

(57) ABSTRACT

A dryer has a blower and means for dividing an airflow into two separate chambers. A drying channel is defined between the two chambers and material to be dried passes along the channel. The walls between the chambers and the channel are apertured to allow air to flow into the channel. The channel increases in cross-sectional area along the length thereof such that air flowing along the channel is subject to a pressure drop. The air thus flows substantially in one direction along the channel.

8 Claims, 5 Drawing Sheets

PHOTOGRAPHIC MEDIA DRYER

CROSS REFERENCE TO RELATED APPLICATIONS

This is a U.S. original patent application which claims priority on Great Britain patent application No. 0123479.8 filed Sep. 29, 2001.

FIELD OF THE INVENTION

This invention relates to the field of photographic processing, in particular to the drying of processed media.

BACKGROUND OF THE INVENTION

In conventional prior art-processors the processed media is passed through a large air chamber for drying. Heated air flows through the chamber but the air flow is not directed in any particular path. The media generally loops around within these large chambers until they are dry. The drying chambers generally cover an area in the region of 25 $cm^2$.

The invention aims to provide a dryer which has a smaller footprint than those known in the prior art and which can be used in a free standing "kiosk" type processing machine. The invention also aims to provide a dryer with minimal moving parts.

SUMMARY OF THE INVENTION

According to the present invention there is provided a dryer comprising a blower, means for dividing an airflow to flow into two chambers, one wall of each chamber being defined by an apertured plate member, the plate members defining a channel therebetween for the passage of a strip of material to be dried, the channel increasing in cross-sectional area along the length thereof such that air flowing along the channel is subject to a pressure drop causing the air to flow substantially in one direction along the channel.

The invention further provides a method of drying a strip of material wherein the material is transported through a channel of increasing cross-sectional area, air being fed into the channel via apertures in opposing walls of the channel and passing substantially in one direction along the channel due to a pressure drop created by the increasing cross-sectional area thereof, the material riding on a self-centering air cushion.

The invention allows for rapid drying of the photographic media. There is no physical contact by rollers or guides during the drying between the media and the dryer. There are therefore fewer moving parts than dryers known from the prior art. This leads to lower costs and less maintenance.

Only low back pressure is required for the airflow and this enables the use of cheaper commercially available hot air blowers. Due to the controlled airflow it is easier to feed the media into the entrance of the dryer.

BRIEF DESCRIPTION OF THE DRAWINGS

The invention will now be described, by way of example, with reference to the accompanying drawings, in which.

DETAILED DESCRIPTION OF THE INVENTION

Figure 1:
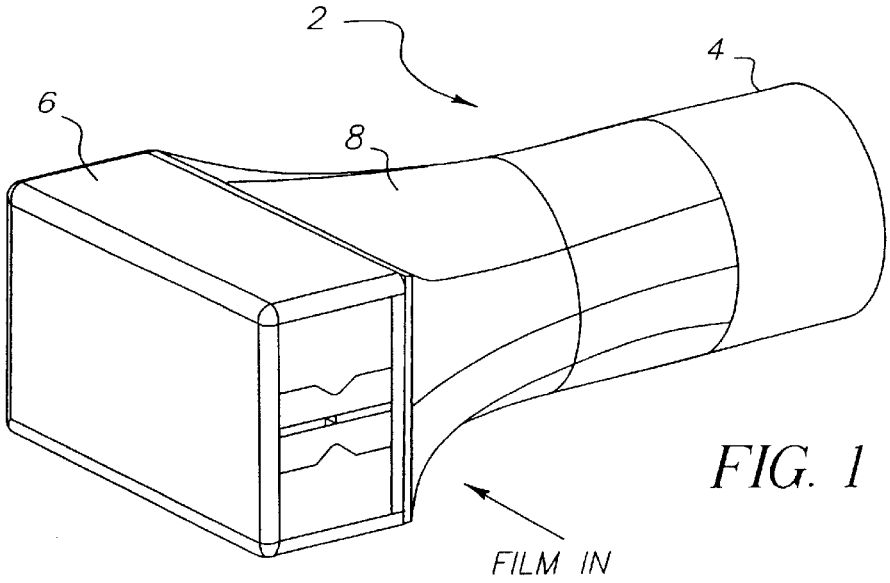
FIG. 1 is a perspective view of a dryer according to the invention.

FIG. 1 is a perspective view of a dryer 2 according to the invention.

The dryer 2 comprises a blower 4, a manifold 8 and a housing 6. The entrance to the dryer is for attachment to a processor. The exit of the dryer may be connected to a scanner or suchlike. However it may not be attached to any further equipment.

The blower 4 causes air to flow through the manifold 8. A dividing plate, not shown, is located within the manifold. The dividing plate divides the air flow into two pathways. The divided air flows into two chambers 20 and 22 which are housed within the housing 6. The chambers are located either side of a drying channel 5. The drying channel 5 is defined by two apertured plenum plates, an upper plate 10 and a lower plate 12. These plenum plates, 10 and 12, form a wall of each chamber, 20 and 22 respectively.

Figure 3:
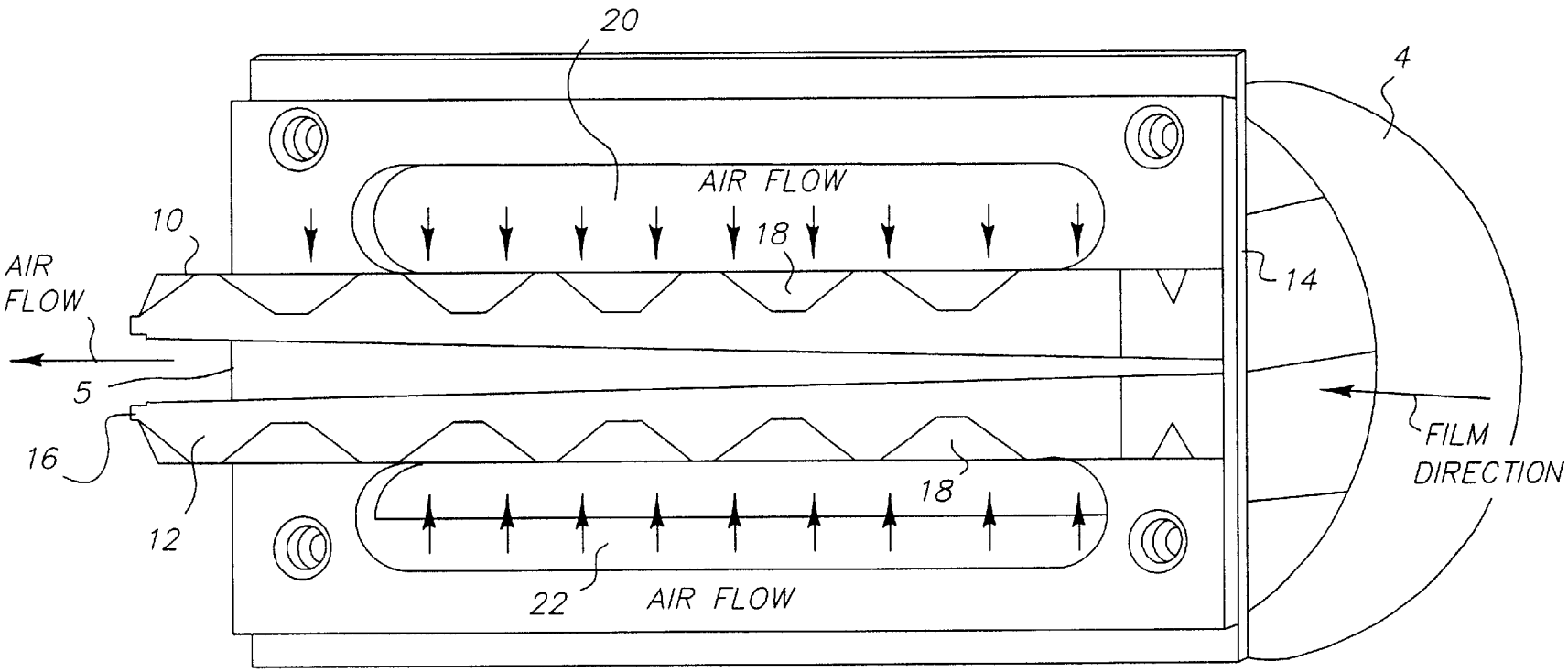
FIG. 3 is a side view of the interior of the dryer.
Figure 4:
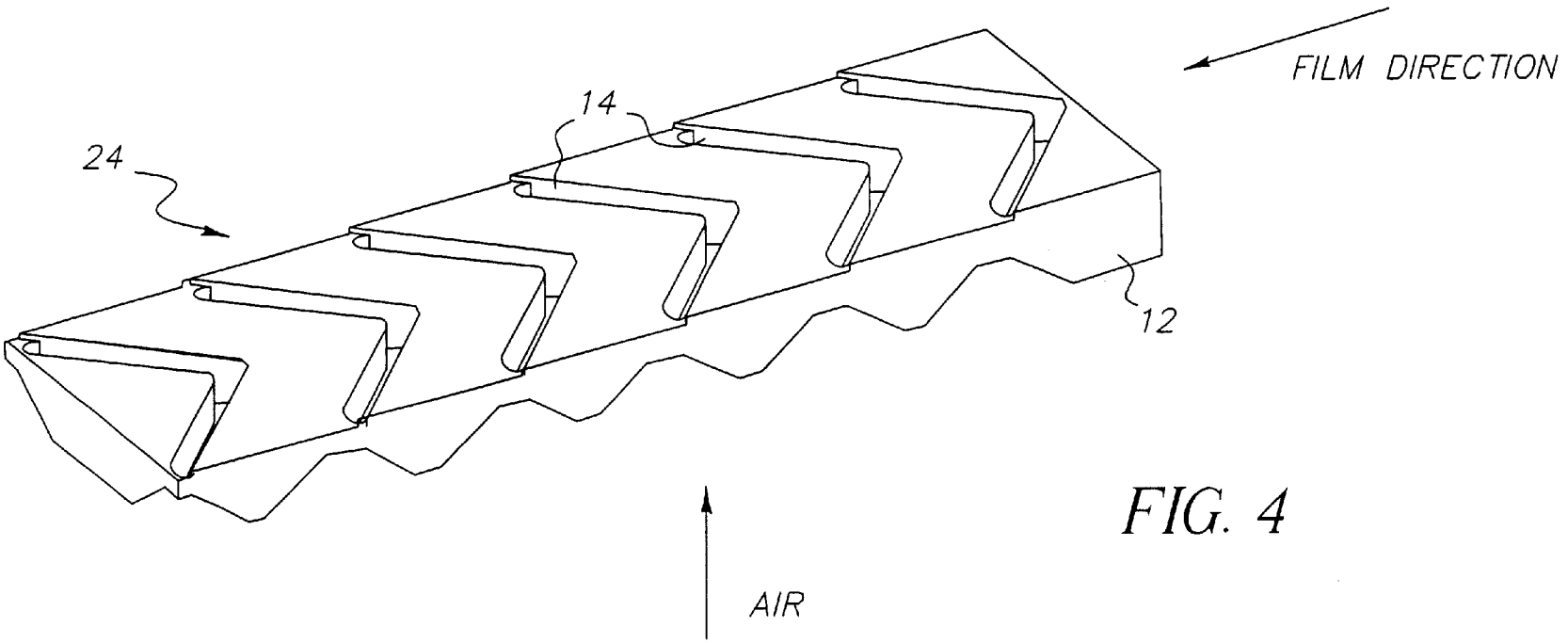
FIG. 4 is a perspective view of a plenum plate.
Figure 5:
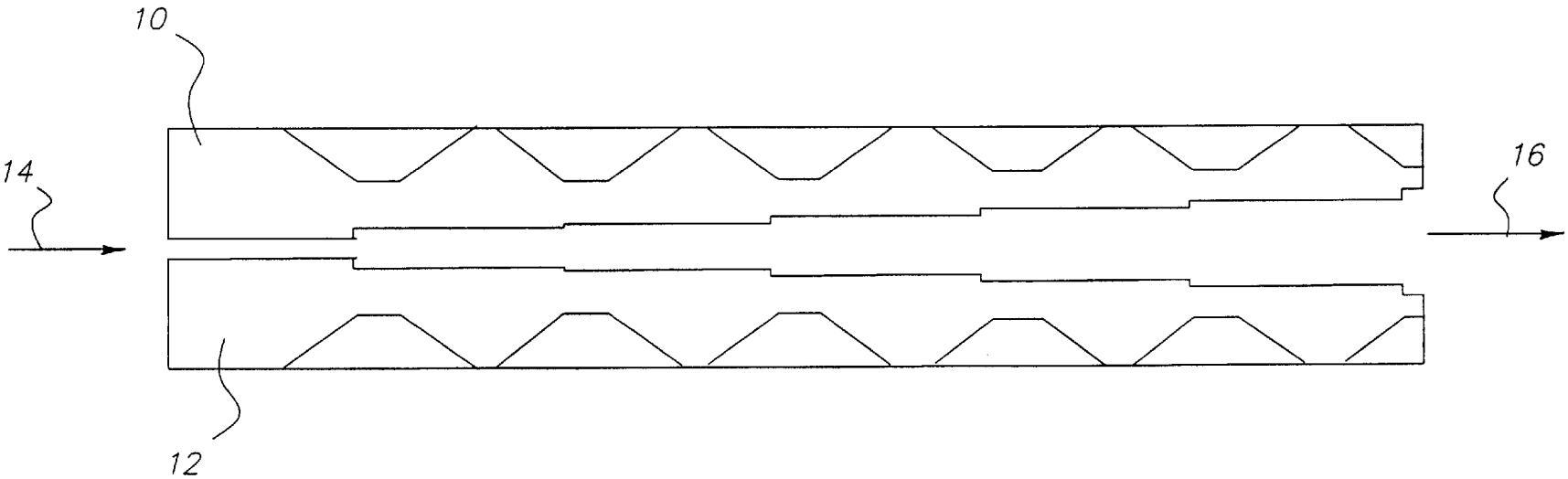
FIG. 5 is a side view of the plenum plates.

The plenum plates 10 and 12 are arranged parallel to each other. The film, or other photographic media, passes between the plates 10 and 12 through the channel 5 from the entrance of the channel 14 to the exit 16 of the channel. The length of the channel is in the region of 150 mm. The inner side of each plenum plate, i.e. that side which forms the wall of the drying channel 5 is provided with a stepped surface 24 such that the walls of the channel 5 diverge from each other. The entrance 15 to the channel is thus narrower than the exit 16 from the channel. This can be clearly seen from FIGS. 3 and 5. The plenum plates are equally stepped to give an entrance to the channel 5 of approximately 0.5 mm and an exit of approximately 6 mm. Both plenum plates have a plurality of V-shaped slots 14 arranged equidistantly along the length thereof. The slots 14 act as nozzles for entry of the hot air to the channel 5 from the chambers. These are illustrated best in FIG. 4. The slots 14 are located at each step of the inner surface of the plate. Each step 24 has a depth of approximately 1 mm. The apex of the V-shaped slot points towards the entrance to the channel, i.e. against the direction of travel of the media through the channel.

Figure 2:
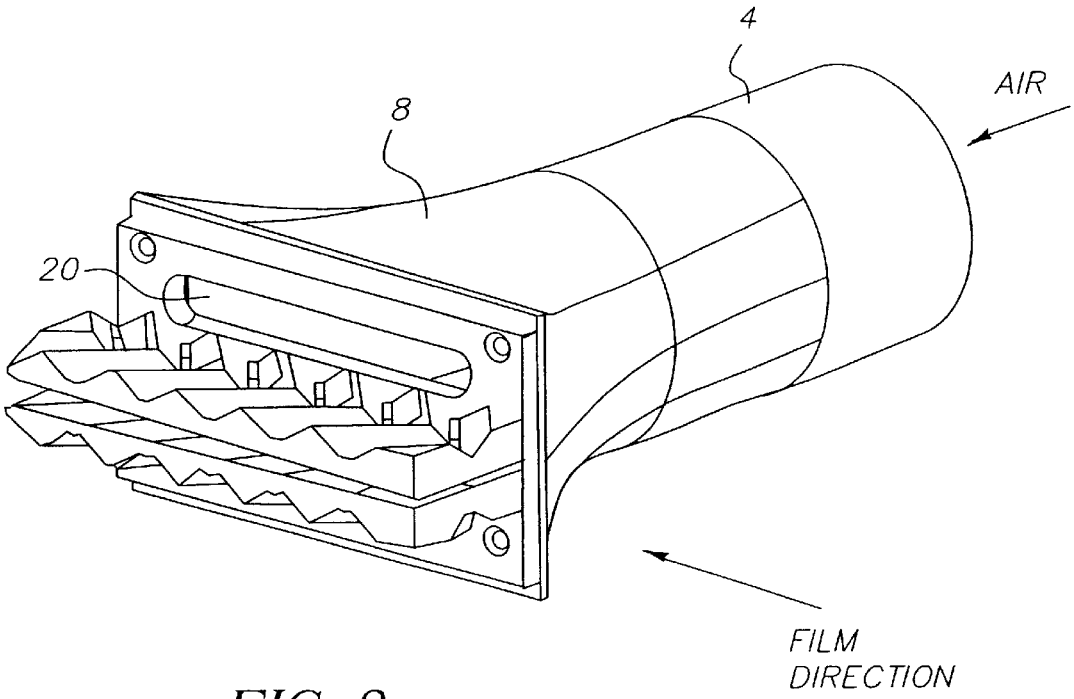
FIG. 2 is a perspective view of the dryer with the housing removed.

The back surface of each plenum plate, i.e. that side which forms the wall of the chamber, is provided with a series of v-shaped channels 18. These are best illustrated in FIG. 2. These channels 18 are shaped so as to provide a smaller cross-sectional area for the flow of air to pass through and so increase the velocity of air as it passes through the plates 10 and 12 from the chambers 20 and 22.

Drive rollers, not shown, are provided outside of the channel, at both the entrance and the exit. The drive rollers transport the media through the channel.

Figure 6A:
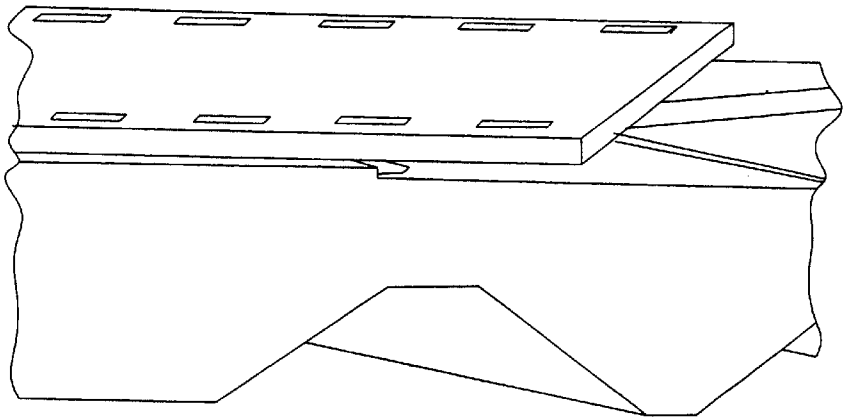
FIGS. 6A and 6B illustrate a strip of processed material travelling through the dryer.
Figure 6B:
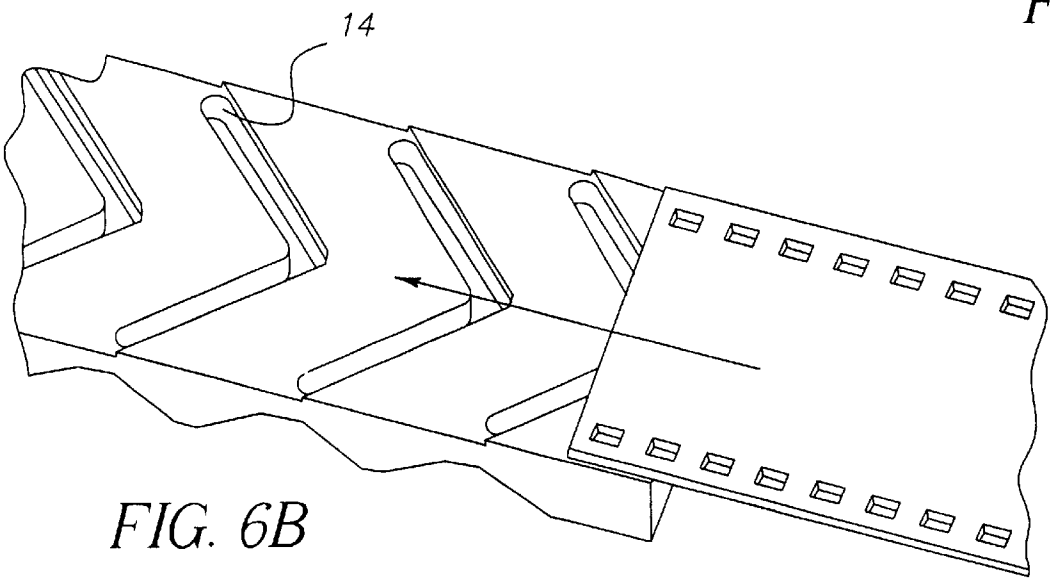

Air enters the dryer 2 via blower 4. The temperature of the air is preferably in the region of 60° C. This temperature gives the best results. However the invention can be used with air at a lower temperature. The air travels through the manifold 8 where it is split into two pathways by the dividing plate. The divided airflow passes into the two chambers, 20 and 22. The air is then directed through the plenum plates 10 and 12. As the air passes through the v-shaped channels 18 on the rear side of the plates the velocity increases. The air then passes through the slots 14 which act as nozzles. Due to the diverging walls of the channel 5 the cross-sectional area of the channel increases. There is therefore a pressure drop along the length of the channel in the direction of film transport. This ensures that the airflow runs in one direction from the area of high pressure to low pressure, i.e. from the entrance 15 of the channel to the exit 16 of the channel. A very small amount of air travels towards the entrance as the V shape of the slots points towards the entrance to the channel. This air flow acts as a "squeegee" or an air knife and drives any liquid on the surface of the media back to the processor. The stepped surface also means that there is less chance of the film, or other photographic media, from sticking to the walls of the channel. As the film passes through the channel 5 it passes over the slots 14 over the apex of the V first. The middle of the front edge of the film is supported by the next step 24 before the edges of the film have left the current step. This is illustrated in FIGS. 6A and 6B. This feature minimizes the risk of the film being trapped in the slot. The film will start to curl as it begins to dry. The V shape of the slots ensures that the edges of the film are not caught.

The arrangement of the dryer allows it to be closely coupled with a processor as there is minimal hot air passing from the dryer into the processing chamber. Furthermore the entrance of the film into the dryer is easier than with conventional dryers known in the prior art. This is because the film is not pushing against a significant airflow. Once the film is inside the dryer the film rides on a self-centering air cushion. This arrangement removes the need for rollers and guides within the dryer. The drying time for a film passing through a dryer according to the invention is approximately 6 to 10 seconds, i.e. the "throughtime" of the film. This is faster than conventional prior art dryers.

The design of the dryer means that back pressure in the drying system is minimized. This allows cheaper and smaller hot air blowers to be used.

It is to be understood that various modifications and changes may be made without departing from the present invention, the present invention being defined by the following claims.

Parts List

2 Dryer
4 blower
5 channel
6 housing
8 Manifold
10 upper plate
12 lower plate
14 slot
15 entrance
16 exit
18 v-shaped channels
20 chamber
22 chamber
24 step

What is claimed is:

1. A dryer comprising a blower, means for dividing an airflow to flow into two chambers, one wall of each chamber being defined by an apertured plate member, the plate members defining a channel therebetween for the passage of a strip of material to be dried, the channel increasing in cross-sectional area along the full length thereof such that air flowing along the channel is subject to a pressure drop causing the air to flow substantially in one direction along the channel.

2. A dryer as claimed in claim 1 wherein the thickness of each plate member decreases along its length to thereby increase the cross-sectional area of the channel.

3. A dryer as claimed in claim 2 wherein the thickness decreases in steps.

4. A dryer as claimed in claim 3 wherein the steps have a depth of approximately 1 mm.

5. A dryer as claimed in claim 1 wherein the apertures in the plates are v-shaped slots.

6. A dryer as claimed in claim 1 wherein the side of each plate member remote from the channel is provided with a plurality of v-shaped channels to increase the velocity of air flow through the apertures.

7. A dryer as claimed in claim 1 wherein the length of the channel is in the region of 150 mm.

8. A dryer as claimed in claim 1 wherein the temperature of the air is in the region of 60° C.

* * * * *